United States Patent [19]

Boys, II et al.

[11] Patent Number: 4,783,910

[45] Date of Patent: Nov. 15, 1988

[54] CASUAL SHOE

[76] Inventors: Jack A. Boys, II, 35 Woodcock Ave., Haverhill, Mass. 01830; Richard P. Bunch, 50 Prospect St., Reading, Mass. 01867; Alexander L. Gross, 85 E. India Row #33D, Boston, Mass. 02110; Robert W. Pagluiso, 17 Bates St., Methuen, Mass. 01844; Rui M. Parracho, 14 Anthony Rd., Peabody, Mass. 01960; Lloyd S. Smith, 10 Langley Rd., Newton Centre, Mass. 02159

[21] Appl. No.: 879,897

[22] Filed: Aug. 15, 1986

[51] Int. Cl.[4] ..... A43B 7/32; A43B 13/12

[52] U.S. Cl. ..... 36/107; 36/108; 36/30 R; 36/35 R; 128/590

[58] Field of Search ..... 36/30 R, 91, 76 R, 35 R, 36/43, 44, 28, 31, 37, 107, 108; 128/80 D, 586, 589, 590, 594, 595

[56] References Cited

U.S. PATENT DOCUMENTS

| | | | |
|---|---|---|---|
| 930,990 | 8/1909 | Rogers | 36/35 R |
| 1,592,839 | 7/1926 | Siegfried | 36/35 R |
| 1,601,684 | 9/1926 | Drake | 36/76 R |
| 1,920,112 | 7/1933 | Shaft | 36/28 |
| 2,240,835 | 5/1941 | Cobb | 36/35 R |
| 2,362,497 | 11/1944 | Moore | 36/76 R |
| 2,407,498 | 9/1946 | Johnson | 36/108 |
| 3,161,970 | 12/1964 | Purtell | 36/43 |
| 4,033,054 | 7/1977 | Fukuoka | 36/91 |
| 4,124,946 | 11/1978 | Tomlin | 36/43 |
| 4,133,118 | 1/1979 | Khalsa et al. | 36/44 |
| 4,316,335 | 2/1982 | Giese et al. | 36/35 R |
| 4,364,188 | 12/1982 | Turner et al. | 36/91 |
| 4,580,359 | 4/1986 | Kurrash et al. | 36/107 |

FOREIGN PATENT DOCUMENTS

| | | | |
|---|---|---|---|
| 2499377 | 8/1982 | France | 36/91 |
| 1437329 | 5/1976 | United Kingdom | 36/76 R |

*Primary Examiner*—Steven N. Meyers

[57] ABSTRACT

A shoe includes a midsole with an anti-G-force heel capsule that nests in a corresponding aperture in the heel. The heel capsule interacts with an anti-torsion member, the rearmost portion of which lies proximate to the heel plug, and with an energy-efficient forefoot midsole section, thus providing a support and cushioning system that absorbs shocks associated with walking, and also prevents excessive pronation.

6 Claims, 4 Drawing Sheets

CASUAL SHOE

DESCRIPTION

Technical Field

The present invention relates to shoes in general and in particular to casual footwear providing support and cushioning.

BACKGROUND OF THE INVENTION

It has long been an object of shoe designers to provide wearers with an optimum combination of comfort and support. Two particular problems addressed by the prior art are cushioning impacts against the pavement or other walking surface and preventing pronation. The various elements employed by shoe designers to promote these and other ends include heel plugs and shanks. Heel plugs and other similar devices used to cushion walking are known in the art. See, for example, U.S. Pat. Nos. 1,724,349 to Haag, and 4,342,158 to McMahon. Shanks of various shapes are known. See, for example, Browne, U.S. Pat. No. 819,845. However, it is not known in the prior art to combine these or similar elements to take advantage of any structural interaction they may have.

DISCLOSURE OF INVENTION

The present invention fills this gap in the prior art by providing a casual shoe with a specially designed anti-G-force capsule, an anti-torsion member and an energy efficient forefoot midsole section that interact with each other to prevent pronation and also to provide cushioning from the shocks associated with day-to-day walking on various surfaces.

DESCRIPTION OF SPECIFIC EMBODIMENTS

Figure 1:
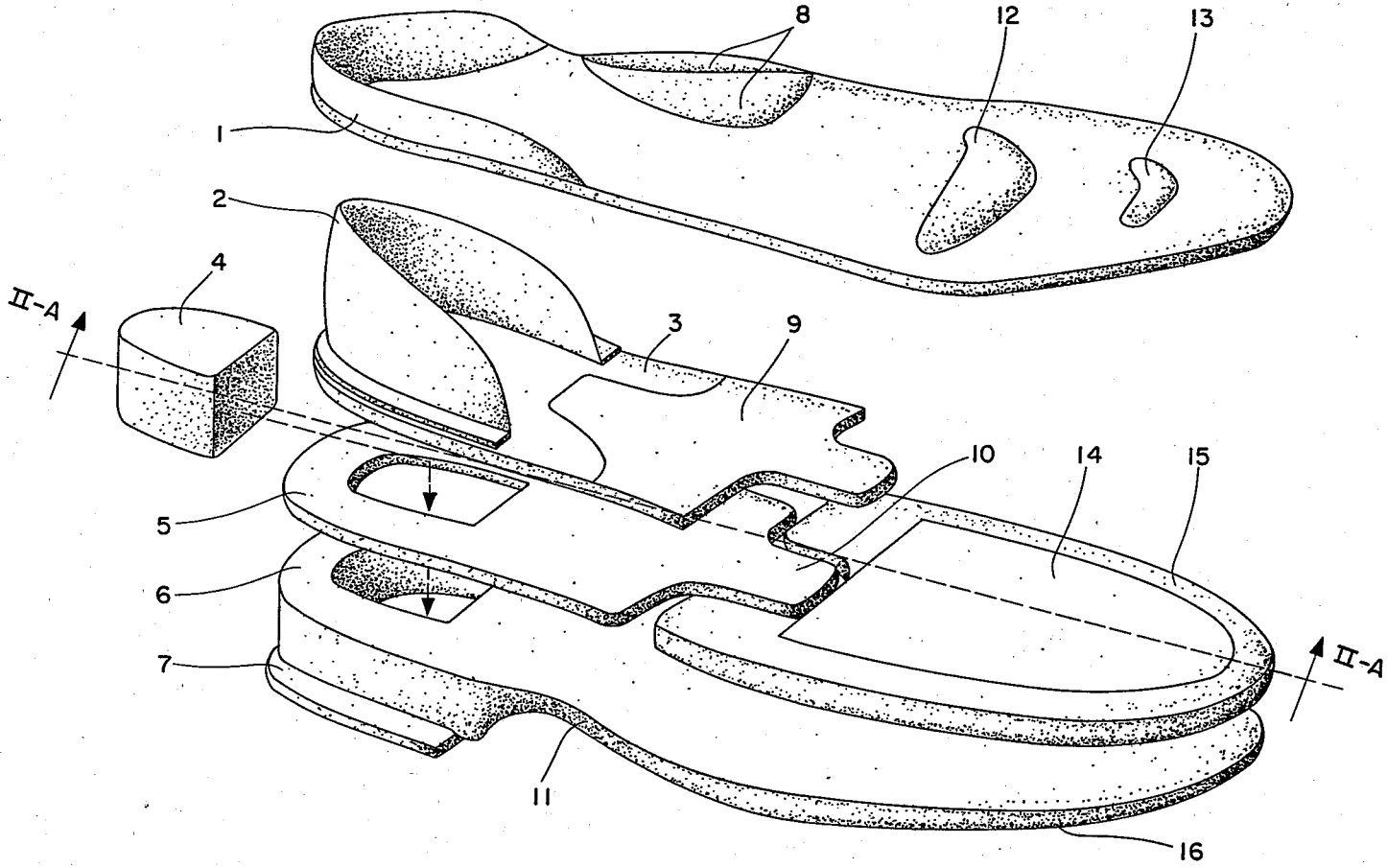
FIG. 1 shows an exploded view of a preferred embodiment of a shoe according to the present invention (upper not shown).
Figure 2:
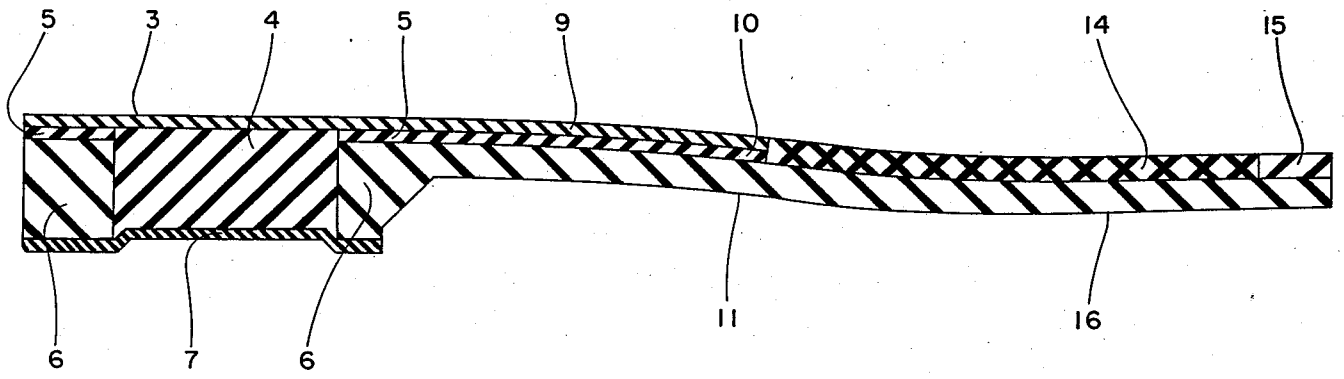
FIG. 2 shows a longitudinal section of the midsole and outsole of FIG. 1 taken vertically through the axis A—A shown in FIG. 1.
Figure 3:
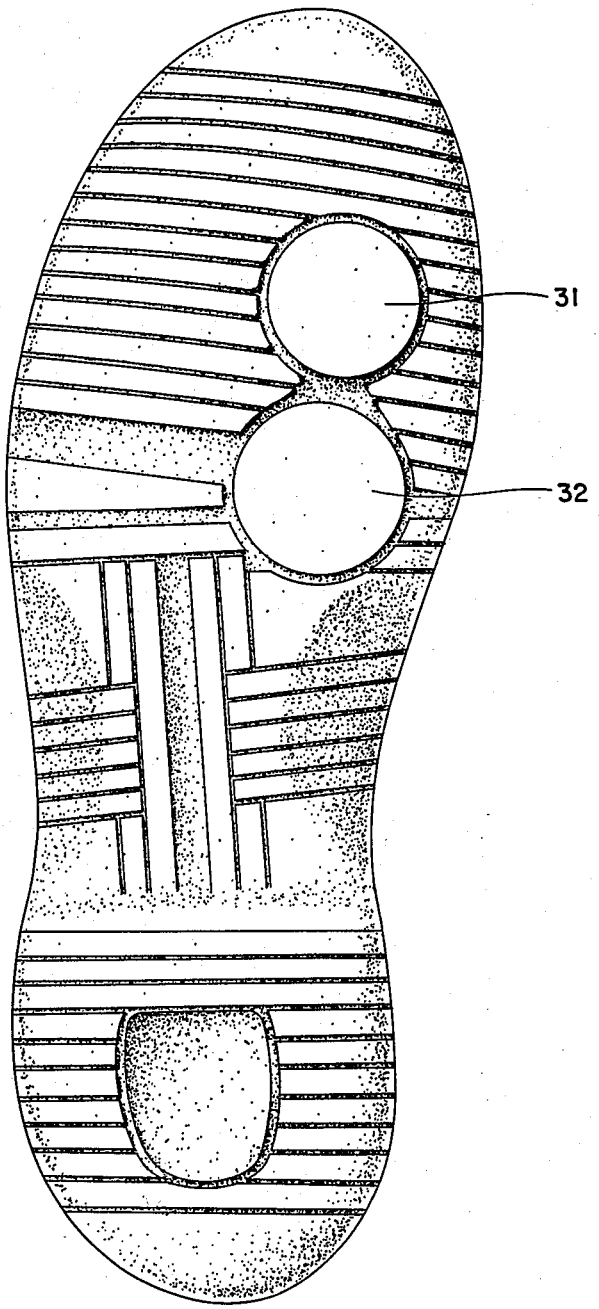
FIG. 3 shows a plan view from below of a preferred embodiment of an outsole according to the present invention
Figure 4:
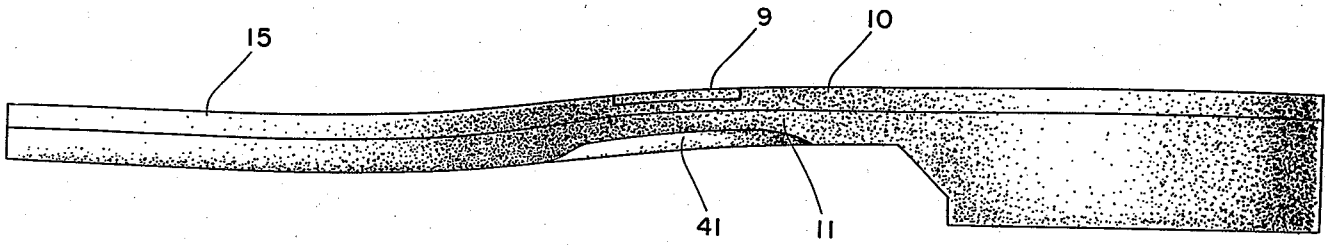
FIG. 4 shows a plan view from the medial side of the outsole shown in FIG. 1.

FIG. 1 shows a preferred embodiment of the present invention. The upper of the rearfoot section of the embodiment is the heel section of an insert-type of insole containing a visco-elastic circumferential heel pad 1, made of a textile-covered blown polyurethane (PU) and a blown ethylene vinyl acetate/polyethylene (EVA/PE) system which contains and self-centers the adipose heel pad and issue beneath the calcaneous to help enhance natural shock absorption. The heel pad is particularly effective for handling off-center loads encountered during normal heel strike.

Along the back portion of rearfoot section of the present embodiment is a semi-rigid heel counter 2, made of a thermoplastic material, which contains the spread of motion of the visco-elastic heel pad of the insert, thus providing control during the heel strike phase.

A composite midsole is made up of an upper portion forming a force moderator layer 3, a lower portion forming a stable perimeter layer 5 and a forefoot portion forming another stable perimeter layer 15. The force moderator layer 3, composed of a rubber modified ethylene acetate vinyl (EVA) blown microcellular material, is located beneath the flanged heel counter 2 and resting atop a stable peripheral layer 5 of a similar material, located beneath the midfoot shank 9, and surrounding an anti-G-force capsule 4.

The capsule 4 is made of a special polyethylene, ethylene vinyl acetate, rubber (PE/EVA/rubber) blend of blown microcellular material with a durometer of approximately 50±3 on the Asker C scale. The rubber may be styrene butadiene rubber (SBR), polyisobutadiene, or polyisoprene. The purpose of the use of the moderator layer 3 in combination with the anti-G-force capsule 4 is to provide well distributed shock absorption to the calcaneal portion of the foot.

A higher density stable platform 6, totally surrounding the anti-G-force capsule 4, is incorporated in the heel section of the outsole. For both density and ground reaction force control purposes, the stability rim is composed of a high rubber content EVA material with a durometer of approximately 72±3 on the Asker C scale.

Finally, a solid rubber heel area wear plug 7, is also provided below the platform layer 6 previously described. The rubber plug 7 contains a recessed center of pressure rubber membrane which protects the anti-G-force capsule 4 from ground surface abrasion as well as providing the proper upward directioned recess to affect control of the shock wave associated with ground reaction forces occuring in the heel area of the foot.

The upper portion of the midstance section of the present embodiment includes a self-adjusting dual module medial arch pad 8, which is made of a textile covered blown polyurethane (PU) and blown ethylene vinyl acetate/polyethylene (EVA/PE) system, and provides support not just beneath, but all around (90 degrees) the medial arch.

This module 8 sits atop a highly resilient semi-rigid anti-torsion member 9, which is made of a thermoplastic material. The anti-torsion member 9 forms a part of the upper portion of the midsole and is disposed so that its rear portion lies proximate to the upper portion of the heel capsule 9. The purpose of the member is to assure that when the knee flexes, the shoe does not. A stable navigation platform is provided for center of gravity force translation from rearfoot to forefoot. During this translation, rebound energy is stored in the anti-torsion member 9 to be released during the forefoot associated activities of the gait cycle. Torsional control of lateral/medial, as well as medial/lateral, forefoot stability directions is also provided by the member.

Beneath the anti-torsion member 9 are two additional layers of material 10 and 11. The first layer 10 is the midfoot portion of the EVA material 5 described above and the second layer 11 is the midfoot section of the outsole 6, also described above. Of particular note is the raised arch area 41 of the outsole which is protected from collapse via the stiffness of the anti-torsion member 9, also described above.

The upper portion of the forefoot section of the present embodiment includes a metatarsal pad 12 and a toe crest pad 13, located on the inserted insole, made of a textile-covered blown polyurethane (PU) and a blown ethylene vinyl acetate/polyethylene (EVA/PE) system, which provides the following functions: (a) the metatarsal pad provides an additional layer of cushioning beneath the metatarsal shank arch which buttresses the matatarsal heads themselves and (b) the toe crest serves to spread the toes to assure proper alignment and balance during the toe-off (propulsive) portion of the gait cycle.

Beneath the above components is a layer of highly energy efficient and compliant type of ethylene vinyl acetate (EVA) blown material 14, nested within a stable perimeter of density ethylene vinyl acetate (EVA) blown material 15.

The stable 15 locks completely around the energy efficient material so as to provide a smooth transition ("glide" effect) as the user navigates over the thermoplastic anti-torsion member 9 onto the energy efficient section.

Beneath the above elements is the forefoot section of the outsole 16. This section is thinner, and of higher density for increased forward propulsion, and also contains a pair of pivot discs 31 and 32 for dual location direction change (more forward or more aft, as the situation requires), depending on which position in the stride the direction change takes place.

What is claimed is:

1. A shoe, comprising:

an outsole, including a sole portion and a heel portion, the heel portion including an aperture therein having side walls;

a midsole attached to the top of the outsole, the midsole including a heel capsule having side walls and extending into the aperture in the heel portion of the outsole, wherein the capsule's side walls are generally conformable to those of the aperture; and an anti-torsion member with a central axis lying in a complementarily shaped recess along the central axis of the midsole, the rear portion of the anti-torsion member lying proximate to the upper portion of the heel capsule, such member further including two integrally formed arms transversely disposed with respect to the central axis of the anti-torsion member, and extending towards the sides of the midsole;

such midsole including an energy efficient forefoot section, nested within a higher density perimeter, adjoining the anti-torsion member.

2. A shoe according to claim 1, wherein the heel aperture extends through the entire thickness of the heel portion, and the heel capsule extends most of the way through the aperture, leaving a gap between the capsule and a walking surface.

3. A shoe according to claim 1, wherein the anti-torsion member is resilient.

4. A shoe according to claim 1, further including an insole containing a visco-elastic circumferential heel pad.

5. A shoe according to claim 4, the insole further including a self-adjusting dual module medial arch pad.

6. A shoe according to claim 5, the insole further including a metatarsal pad and a toe crest pad.

* * * * *